United States Patent [19]

Phillips

[11] Patent Number: 4,765,120

[45] Date of Patent: Aug. 23, 1988

[54] FILM WEB PERFORATION

[75] Inventor: Thomas E. Phillips, Louisville, Ky.

[73] Assignee: Lantech, Inc., Louisville, Ky.

[21] Appl. No.: 18,430

[22] Filed: Feb. 25, 1987

[51] Int. Cl.[4] ..... B65B 11/28; B65B 61/02

[52] U.S. Cl. ..... 53/441; 53/211; 53/389; 53/556; 219/384

[58] Field of Search ..... 53/210, 211, 213, 441, 53/442, 556, 557, 389, 410; 219/69 E, 69 M, 69 R, 384

[56] References Cited

U.S. PATENT DOCUMENTS

| | | | |
|---|---|---|---|
| 3,019,573 | 2/1962 | Navikas | 53/211 X |
| 3,921,803 | 11/1975 | Reed | 53/211 X |
| 4,100,396 | 7/1978 | Martin | 219/384 |
| 4,207,458 | 6/1980 | Lilly | 219/384 |
| 4,278,871 | 7/1981 | Schmidt-Kufeke et al. | 219/384 |
| 4,314,142 | 2/1982 | Brown et al. | 219/384 |
| 4,447,709 | 5/1984 | Whitman | 219/384 |
| 4,593,518 | 6/1986 | Lancaster | 53/556 |

FOREIGN PATENT DOCUMENTS

| | | | |
|---|---|---|---|
| 2083002 | 3/1982 | United Kingdom | 53/556 |

*Primary Examiner*—James F. Coan
*Assistant Examiner*—Steven P. Weihrouch
*Attorney, Agent, or Firm*—Finnegan, Henderson, Farabow, Garrett & Dunner

[57] ABSTRACT

A device for perforating a film web while wrapping a load which the film web includes a web dispenser for dispensing the film web and an arrangement for providing relative rotation between the load and the web dispenser to wrap the film web on the load. It also includes electrodes positioned proximate to the film web and an arrangement for generating an arc at the electrodes to perforate the film web with the arc.

17 Claims, 3 Drawing Sheets

FIG 1
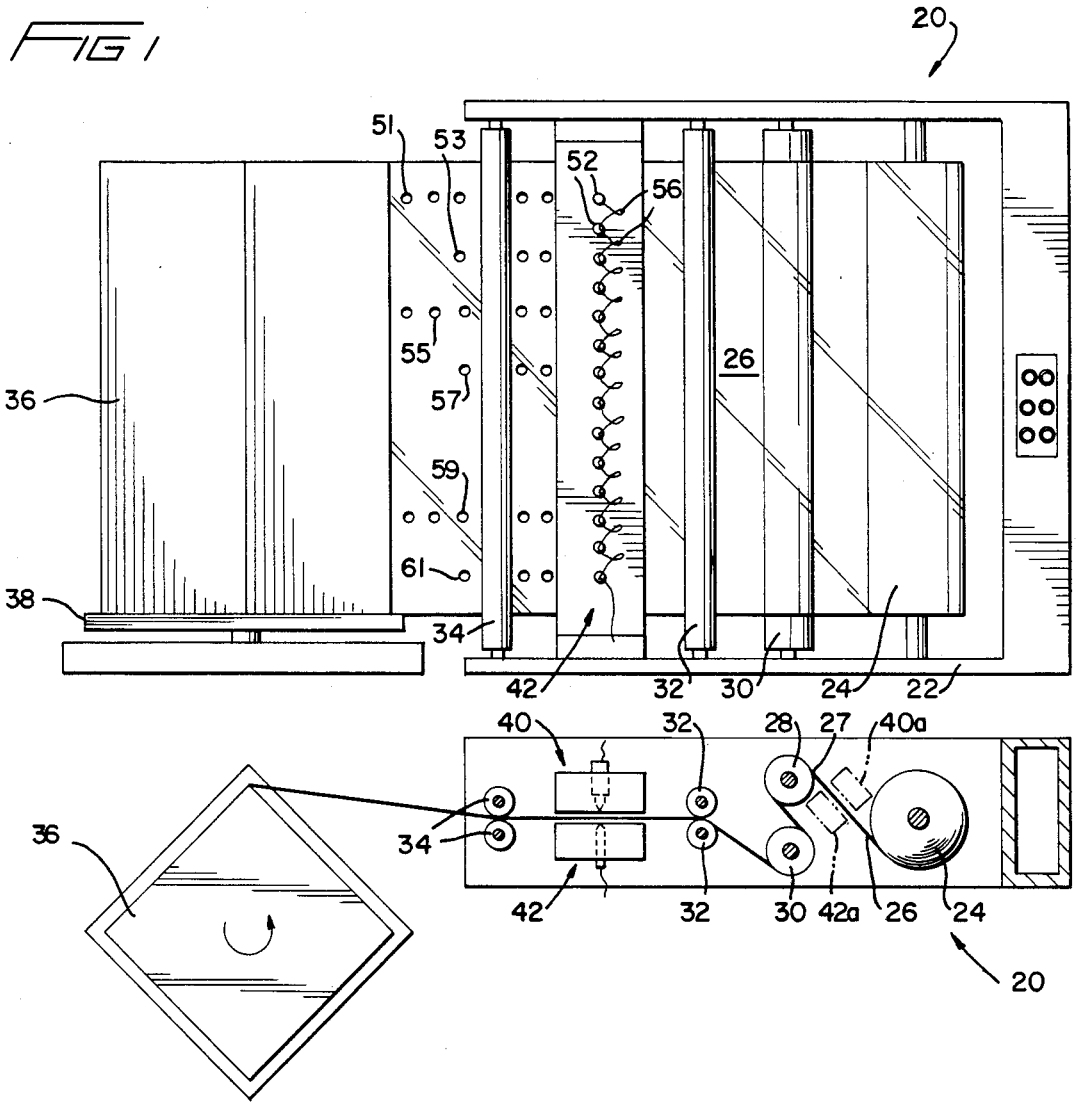
FIG 2
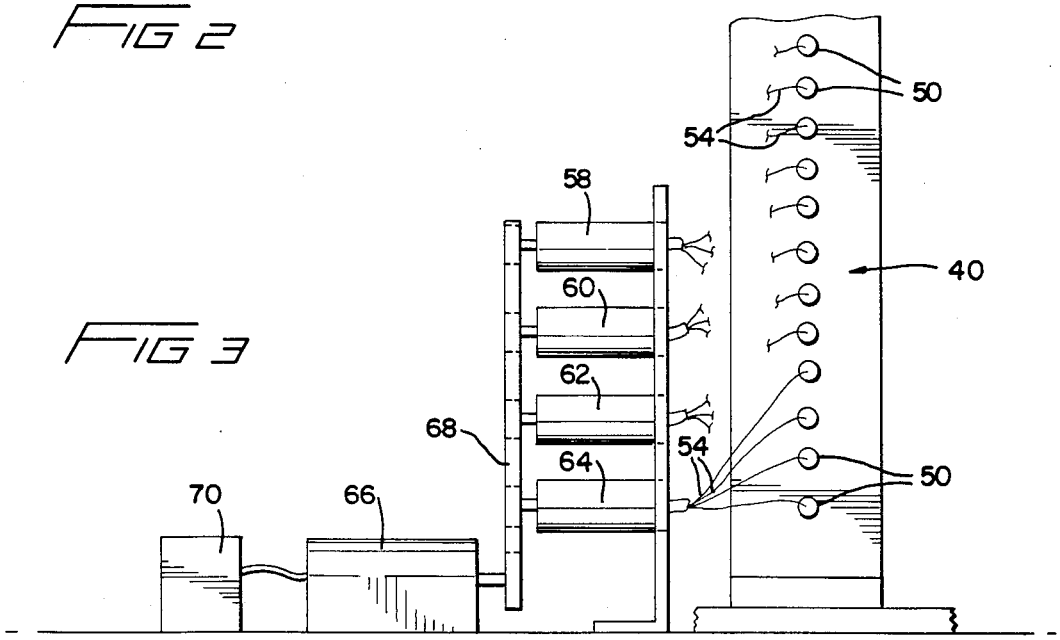
FIG 3

FILM WEB PERFORATION

BACKGROUND OF THE INVENTION

The present invention relates to a method and apparatus for perforating a film web, and more particularly, a method and apparatus for perforating a film web which is wrapped on a load.

Stretch wrapping machines have been used to wrap a load with a web of material to contain the load. Exemplary stretch wrapping methods and apparatus are illustrated in U.S. Pat. Nos. 4,418,510, 4,317,322, and 4,302,920 to Lancaster et al. and assigned to Lantech Inc., which are incorporated herein by reference Some wrapped products are required to be ventilated if they remain wrapped over an extended period of time. As such, either a web of netting has been used, or a web of plastic film with apertures has been used.

The use of netting has several drawbacks. It has a high material cost and the apertures in the netting are available only in certain standard sizes.

The alternative of using plastic film with apertures also has several drawbacks. Apertures which are mechanically created by punching or piercing results in pieces of the plastic film being separated from the web and becoming a foreign substance in the product being wrapped. This is undesirable especially when the product is a consumable such as food or tobacco.

In addition, mechanically creating apertures in film webs conventionally involves apparatus that quickly dull and clog. As a result, such apparatus needs to be cleaned or replaced on a regular basis and thus causes expense and interruption in use of the wrapping equipment.

Furthermore, the apparatus used for making apertures in the film web do not offer the desired flexibility in controlling the size and location of the apertures in the film web.

Also, it has been difficult to control perforation devices to create holes that are large enough to provide air flow but not so large as to cause the film web to lose holding strength. The tearing action of conventional perforation devices sets up weakened areas in the film which promote undesired tearing and loss of film strength.

Further, the requirement that conventional and mechanical perforation devices contact the film increases the sensitivity of the film to tearing and jamming while it is being handled and limits the conditions under which the film can be placed while being perforated, such as the amount of stretch and the variations in stretch of the film while being perforated.

In addition to the need to properly ventilate wrapped products, there is a need to provide wrapped products with a line of weakness or a tear strip in the wrapping material in a reliable inobtrusive manner to facilitate the removal of the wrapping material at a later time.

It is an additional object of the present invention to provide an apparatus for opening and facilitating the removal of the wrapping material when the product is to be used by formation of a line of weakness or tear strip, while avoiding the drawbacks of complex, expensive, and time consuming arrangements, and also to prevent the wrapped product from being damaged in providing such an opening arrangement.

Accordingly, it is an object of the present invention to provide an apparatus for perforating film which does not cause pieces of the plastic film to become separated from the web and become disposed as a foreign substance in the product being wrapped.

It is also an oblect of the present invention to provide an apparatus for perforating film which does not become dull or clogged and neither needs to be cleaned and replaced on a regular basis nor causes expense and interruption in the wrapping or perforation process.

It is another object of the present invention to provide an apparatus for perforating film which offers the flexibility in controlling the size and location of the apertures in the film web.

It is a further object of the present invention to provide an apparatus for perforating film which creates apertures that are large enough to provide air flow but not so large as to cause the film web to lose holding strength.

It is also an object of the present invention to provide an apparatus for perforating film which does not contact the film and which does not limit the conditions under which the film can be placed while being perforated, such as the amount of stretch and the variations in stretch of the film while being perforated.

It is an additional object of the present invention to provide an apparatus which forms a line of weakness or tear strip in the wrapping material in a reliable inobtrusive manner to facilitate the removal of the wrapping material at a later time.

Additional objects and advantages of the invention will be set forth in the description which follows and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, an apparatus is provided for perforating a film web which is wrapped on a load. The apparatus includes web dispenser means for dispensing a film web, and means for providing relative rotation between the load and the web dispenser means to wrap the film web on the load. Electrode means are positioned proximate to the film web, and means are provided for generating an arc at the electrode means to perforate the film web with the arc.

BRIEF DESCRIPTION OF THE DRAWINGS

The accompanying drawings which are incorporated in and constitute a part of the specification illustrate presently preferred embodiments of the invention and, together with the general description given above and the detailed description of the preferred embodiments given below, serve to explain the principles of the invention.

FIG. 1 is a side view of a perforating and wrapping apparatus incorporating the teachings of the present invention;

FIG. 2 is a top sectional view of the arrangement illustrated in FIG. 1;

FIG. 3 is a partial opposite side view of the arrangement illustrated in FIG. 1;

DESCRIPTION OF THE PREFERRED EMBODIMENT

Figure 4:
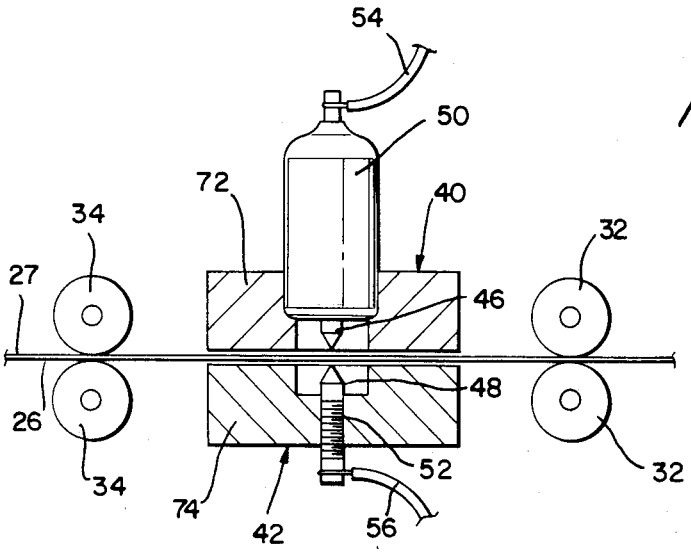
FIG. 4 is a partial top sectional view of the arrangement shown in FIG. 1.

Reference will now be made in detail to the present preferred embodiment of the invention as illustrated in the accompanying drawings.

In accordance with the present invention, apparatus is provided for perforating a film web which is wrapped or load comprising: web dispenser means for dispensing the film web; means for providing relative rotation between the load and the film web dispenser means to wrap the film web on the load; electrode means positioned proximate to the film web; and means for generating an arc at the electrode means to perforate the film web with the arc.

As shown and embodied in FIGS. 1 and 2, the apparatus is incorporated in a stretch wrapping device 20. As shown and embodied in FIG. 6, the apparatus is incorporated in an alternative stretch wrapping device 120.

According to the present invention, a web dispenser means is provided for dispensing the film web. As shown and embodied in FIGS. 1 and 2, the film web dispenser means includes a frame 22 for supporting a roll 24 of film web 26 such as the kind used in conventional stretch wrapping operations. As shown and embodied in FIG. 6, the film web dispenser means includes a conventional rotating motor-driven ring 122 for supporting a roll 124 of film web 126.

It is preferable that the web dispenser means also include means for prestretching the film web. As best showr in FIG. 2, the prestretching means includes prestretch rollers 28 and 30 which prestretch film web 26 in a known manner, such as being driven at different rotational speeds by a mechanical interconnection such as gears or sprocket and chain. As shcwn in FIG. 2, film web 26 proceeds along a film web path 27 which is determined by the position of the film web during wrapping. The film web and film web path proceeds from roll 24 through prestretch rollers 28 and 30 and through additional guiding rollers 32 and 34 to a load 36, such as an array of stacked cartons or a bale of tobacco. A similar prestretch arrangement may be provided on the arrangement shown in FIG. 6.

Figure 6:
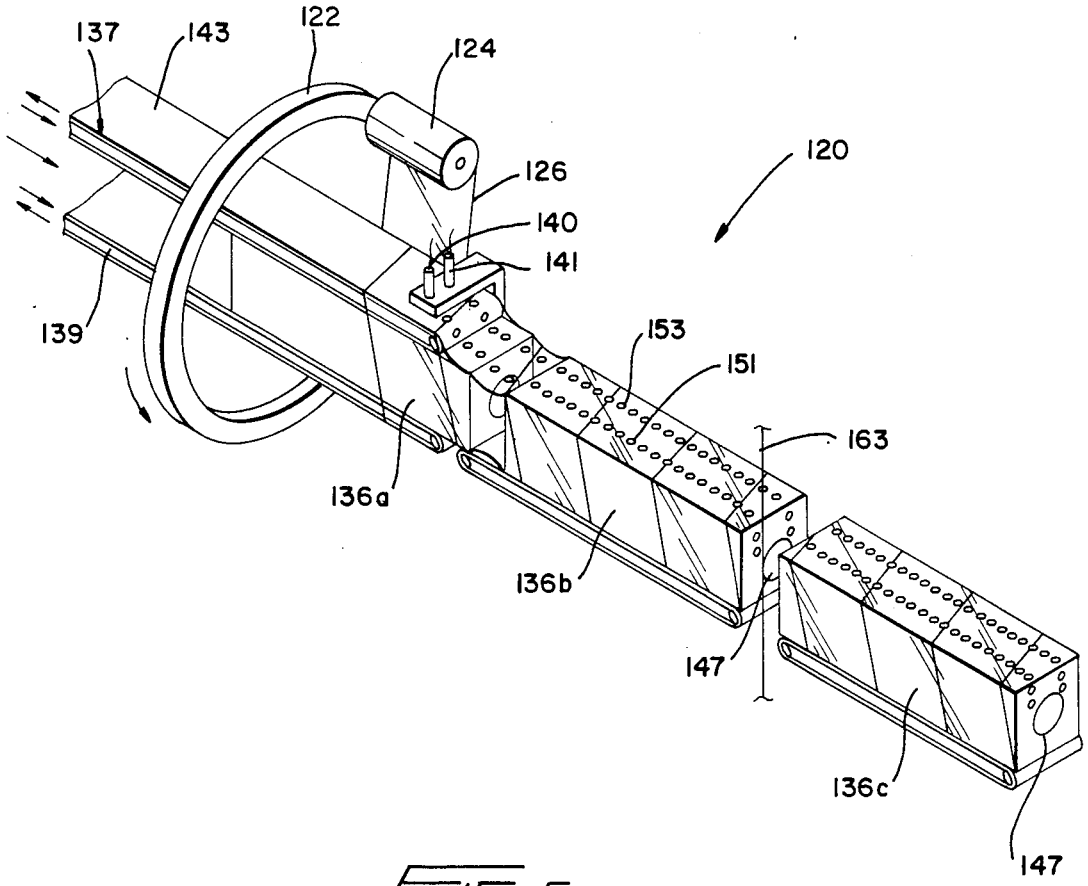
FIG. 6 is a perspective view of another perforating and wrapping apparatus incorporating the teachings of the present invention.

In accordance with the present invention there is provided means for providing relative rotation between the load and the web dispenser means to wrap the film web on the load. As shown and embodied in FIG. 1, the means for providing relative rotation includes a conventional motor-driven turntable 38 on which load 36 is supported and rotated. As shown in FIG. 6, the means for providing relative rotation includes motor-driven ring 122 which revolves roll 124 of film web 126 around the load 136 and wraps film web 126 around load 136 and wrapping conveyors 137 and 139. A similar means for providing relative rotation is disclosed in U.S. Pat. No. 4,317,322.

In accordance with the present invention, there is provided electrode means positioned proximate to the film web. It is preferred that the electrode means include at least one pair of spaced electrodes positioned on opposite sides of the film web. As shown and embodied in FIGS. 2 and 4, the electrode means include two arrays of supported electrodes 40 and 42 positioned on opposite sides of the film web path 27.

As shown and embodied in FIG. 6, the electrode means includes a first set of electrodes 140 and 141 having a first polarity. It is preferable that the electrode means also include a mandrel on which the film web is wrapped and from which the film web is transferred to the load. As shown and embodied in FIG. 6, the mandrel portion of the electrode means includes an endless metallic belt 143 having a second polarity opposite the first polarity. The endless metallic belt forms part of conveyor assembly 137 on which film web 126 is wrapped, conveyed with the load and then transferred onto the load at the downstream end of wrapping conveyor assemblies 137 and 139.

It is also preferable to have means for providing relative movement between the wrapped film web and the electrode means for forming at least one row of perforations in the wrapped film web. As shown in FIG. 6, the means for providing relative movement includes wrapping conveyor assemblies 137 and 139 which, as described above, convey the wrapped web relative to electrodes 140 and 141. The arrangement shown in FIG. 6 is especially useful in forming two lines of weakness and a pull strip between the two lines of weakness for facilitating removal of the wrapped web from the load at a later time. As can be seen from wrapped loads **136*b* and 136*c* of FIG. 6, which have been separated by hot wire 163, the lines of weakness can form a pull tab extending along one side surface of the load and down to the "bull's eye" portion 147** of the wrapped web.

It is preferred that the electrode means include an array of electrodes, the array extending in a direction across the film web for forming a plurality of rows of perforations in the film web. As shown and embodied in FIGS. 1, 2, and 3, supported electrodes 40 and 42 each include an array of electrodes, each array extending across film web path 27 in a perpendicular transverse direction on opposite sides of the film web path 27 for forming rows of perforations 51, 53, 55, 57, 59 and 61. As shown and embodied in FIG. 6, an array of electrodes 140 and 141 form rows of perforations 151 and 153.

Preferably, the electrodes have tapered opposing points. As embodied and shown in Fiq. 4, the supported electrodes 40 and 42 include opposing conductors 46 and 48 having tapered opposing points. It is further preferred that the tapered points are conical having base angles of approximately 60 degrees.

Preferably, the points are spaced apart about $\frac{1}{8}$ of an inch. As shown in the embodiment of FIG. 4, the points of conductors 46 and 48 are spaced apart about $\frac{1}{8}$ of an inch. Although other spacings are possible, the combination of this spacing and the use of the preferred conductor points is currently preferable in use with conventional stretch wrapping films.

Preferably, the electrode pairs include a conventional automotive spark plug 50 having a central conductor 46. The spark plug's secondary conductor is removed and replaced with an opposing conductor 48 which is part of a threaded brass shank 52.

In accordance with the present invention there is provided means for generating an arc at the electrode means to perforate the film web with the arc. As shown and embodied in FIGS. 3 and 5, the means for generating an arc includes magnetos 58, 60, 62 and 64. Wires 56 commonly connect conductors 48 to a ground terminal of magnetos 58, 60, 62 and 64. Wires 54 connect opposite electrodes 46 to a positive terminal of magnetos 58, 60, 62 and 64 which selectively form an arc between each respective pair of conductors 46 and 48.

Preferably, distributor means is provided for sequentially and repeatedly supplying current to at least one of the electrodes. As shown in FIG. 3, the distributor means include distributor magnetos 58, 60, 62, and 64. While other means of providing a timed current pulse may be used, it is presently preferable to use conventional automobile magnetos manufactured by Ronco of Blue Bell, Pennsylvania. Wires 54 are connected to the various positive terminals of the magnetos 58, 60, 62 and 64 so that timed current pulses are sequentially and repeatedly supplied to spark plugs 50. Magnetos 58, 60, 62 and 64 are rotationally driven by a DC motor 66 through a timing belt 68. DC motor 66 is controlled by a controller 70 to turn the magnetos in a range of 0 to 1800 rpm thus controlling the timing of the current pulses and hence the spacing of the apertures formed in the web film.

Preferably, guide means are provided proximate to the row of electrodes for preventing the film web from contacting the electrodes. As shown in FIG. 4, guide means include guide rollers 32 and 34 which prevent the film web from contacting the electrodes as well as electrode supports 72 and 74 which support spark plugs 50 and the opposing conductors 48.

It is also preferred that the distributor means includes means for selectively producing an arc at the first set of electrodes at a greater frequency relative to a second set of electrodes to form a greater number of perforations in one portion of the film web relative to another portion of the film web. It is further preferable that the means for generating the individual arcs is selectively adjustable during operation of the apparatus.

Figure 5:
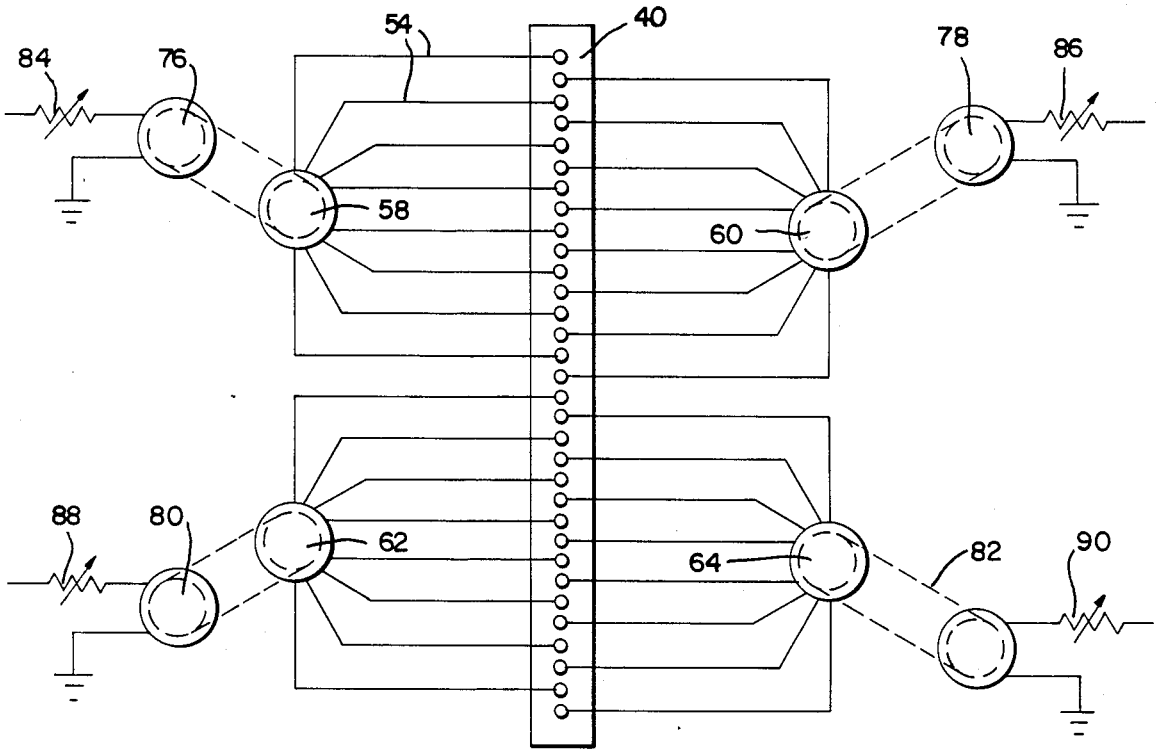
FIG. 5 is a schematic wiring diagram for the device illustrated in FIG. 1.

As embodied in FIG. 5, the supported electrodes 40 are connected to distributing magnetos 58, 60, 62 and 64. Each magneto is rotatively and respectively driven by selectively controllable DC motors 76, 78, 80 and 82 and controlled by potentiometers 84, 86, 88 and 90. The DC motors can be driven at different relative speeds to cause the respective magnetos to generate arcs at different relative frequencies.

As a result, various selected patterns of perforation 51, 53, 55, 57, 59, 61 can be produced, such as that shown in FIG. 1 on various portions of the film web. The use of an electrically produced arc to create the perforations allows continuous selective electronic control of the frequency and therefore spacing of the perforations.

It is preferable, when it is desired not to substantially deform the shape of the perforations after they have been made, that the prestretching means be positioned upstream of the means for creating an arc. As shown in FIG. 2, prestretcting means such as rollers 28 and 30 is positioned upstream of the means for creating an arc such as supported electrodes 40 and 42.

It is preferable, when it is desired to elongate the shape of the perforations after they have been made, that the prestretching means be positioned downstream of the means for creating the arc. As embodied in FIG. 2, prestretching rollers 28 and 30 are positioned downstream of the means for creating an arc such as supported electrodes 40*a* and 42*a*.

In accordance with the present invention, apparatus is provided for perforating a film web comprising: means for dispensing the film web along a film web path and means for taking up the film web; electrode means positioned proximate to the film web path; and means for creating an arc at the electrode means to perforate the film web with the arc.

As noted above, it is preferred that the means for taking up the film web includes the load and means for rotating the load relative to the web dispensing means. However, as an alternative, the means for taking up the film web may include a spool on which the film web is wound after being dispensed and passed through the spaced electrode means. In such a fashion, the film web could be perforated, rolled on a spool, and then used for wrapping at another time. However, it is preferable that perforation and wrapping simultaneously occur because of the advantages of the single operation and the continuous and individualized selective control over perforation that is possible for any given load.

Additional advantages and modifications will readily occur to those skilled in the art. The invention in its broader aspects is, therefore, not limited to the specific details, representative apparatus and illustrative embodiments shown and described. Accordingly, departures may be made from such details without departing from this spirit or scope of the general inventive concept as defined by the appended claims and their equivalents.

What is claimed is:

1. Stretch wrapping apparatus for simultaneously perforating a film web, stretching the film web and wrapping the stretched film web on a load comprising:
   - web dispenser means for dispensing and stretching the film web along the direction in which is it is dispensed;
   - means for providing relative rotation between the load and the web dispenser means to wrap the stretched film web on the load;
   - spaced electrode means positioned proximate to the film web; and
   - means generating an arc at the electrode means to perforate the film web with the arc while the film web is being wrapped on the load.

2. The apparatus of claim 1 wherein the electrode means includes at least one pair of spaced electrodes positioned on opposite sides of the film web.

3. The apparatus of claim 1 wherein the electrode means includes an array of electrodes, the array extending in a direction across the film web path for forming a plurality of rows of perforations in the film web.

4. The apparatus of claim 2 wherein said at least one electrode pair have tapered opposing points.

5. The apparatus of claim 4 wherein the points are spaced apart about one-eighth of an inch.

6. The apparatus of claim 3 including guide means proximate to the row of electrodes for preventing the film web from contacting the electrodes.

7. The apparatus of claim 3 wherein the means for generating an arc includes distributor means for sequentially and repeatedly supplying current to at least one of the electrodes.

8. The apparatus of claim 1 wherein the web dispenser means includes means for prestretching the film web.

9. The apparatus of claim 7 wherein the distributor means includes means for selectively generating an arc at a first set of electrodes at a greater frequency relative to a second set of electrodes to form a greater number of perforations in one portion of the film web relative to another portion of the film web.

10. The apparatus of claim 9 wherein the means for selectively generating an arc is selectively adjustable during operation of the apparatus.

11. The apparatus of claim 1 including means for prestretching the film web positioned upstream of the electrode means.

12. The apparatus of claim 1 including means for prestretching the film web positioned downstream of the electrode means.

13. Apparatus for perforating a film web and wrapping a load with the film web comprising:

web dispenser means for dispensing the film web;

means for providing relative rotation between the load and the web dispenser means to wrap the film web on the load;

electrode means positioned proximate to the wrapped film web, the electrode means including a mandrel on which the film web is wrapped and from which the wrapped film web is transferred to the load;

means for generating an arc at the electrode means to perforate the film web with the arc; and means for providing relative movement between the wrapped film web and the electrode means for forming at least one row of perforatons in the wrapped film web.

14. Apparatus for perforating a film web and wrapping a load with the film web comprising:

web dispenser means for dispensing the film web;

means for providing relative rotation between the load and web dispenser to wrap the film web on the load;

electrode means positioned proximate to the wrapped film web, the electrode means including a first electrode on which the film web is wrapped and a second electrode spaced from the first electrode; and means for generating an arc at the electrode means to perforate the wrapped film web with the arc.

15. The apparatus of claim 14 including means for providing relative movement between the wrapped film web and the second electrode for forming at least one row of perforations in the wrapped film web.

16. The apparatus of claim 14 wherein the first electrode includes a mandrel on which the film web is wrapped and from which the wrapped film web is tranferred to the load.

17. A stretch wrapping process for perforating a film web, stretching the film web and wrapping the stretched film web on a load comprising:

dispensing a film web from a film web dispenser and stretching the film web along the direction in which it is dispensed;

providing relative rotation between the load and the film web dispenser to wrap the stretched film web on the load; and generating an arc between spaced electrodes positioned proximate to the film web to perforate the film web with the arc while the web is being wrapped on the load.

* * * * *